United States Patent [19]

Berger

[11] 4,059,043

[45] Nov. 22, 1977

[54] METHOD AND APPARATUS FOR MAKING TOBACCO SMOKE FILTERS

[75] Inventor: Richard M. Berger, Richmond, Va.

[73] Assignee: American Filtrona Corporation, Richmond, Va.

[21] Appl. No.: 698,684

[22] Filed: June 22, 1976

Related U.S. Application Data

[62] Division of Ser. No. 644,144, Dec. 24, 1975, Pat. No. 3,994,306.

[51] Int. Cl.[2] ..... A24C 5/50

[52] U.S. Cl. ..... 93/1 C; 93/77 FT; 131/10.5

[58] Field of Search ..... 131/261 R, 261 B, 264–267, 131/10.5; 93/1 C, 77 FT

[56] References Cited

U.S. PATENT DOCUMENTS 3,546,325 12/1970 Muller ..... 93/1 C UX 3,847,064 11/1974 Berger ..... 93/77 FT X

*Primary Examiner*—James F. Coan

*Attorney, Agent, or Firm*—Holman & Stern

[57] ABSTRACT

Tobacco smoke filters and methods and means for making same wherein the products have a composite substantially cylindrical inner member formed from two semi-cylindrical inner elements and overwrapped with a common plug wrap. The composite inner member has a discrete inner cavity formed in each semi-cylindrical element and a composite cavity formed by a depressed portion in each semi-cylindrical element. A substantially smooth outer surface is provided on the composite inner member for attaching a conventional plug wrap without the need for an internal glue line. Separate cylindrical elements are reformed into semi-cylindrical elements and crimped to provide depressed pockets, following which the semi-cylindrical elements are mated and overwrapped to produce the final product.

8 Claims, 9 Drawing Figures

METHOD AND APPARATUS FOR MAKING TOBACCO SMOKE FILTERS

This is a divisional of application Ser. No. 644,144 filed Dec. 24, 1975, now U.S. Pat. No. 3,994,306.

This invention relates to the production of filter means, and relates more particularly to tobacco smoke filter elements. More specifically, the instant inventive concepts are primarily concerned with producing filter means for cigarettes, although the products of this invention are generally useful as filters, particularly for tobacco smoking means, whether they be cigarettes, cigars, pipes or the like. Since filters for cigarettes are particularly commercially important, the basic embodiments of the instant invention will be discussed as they relate to the production of filtered cigarettes.

Various prior art techniques are known for making filters for use in connection with cigarettes and the like, although the resultant products, in general, have one or more disadvantages. Perhaps the most important property of the filter means is its efficiency, that is, its ability to remove undesirable constituents from tobacco smoke. Filtration efficiency is ordinarily measured in terms of the percentage of total particulate matter (TPM) removed from the smoke, although there is also some concern for the percentage of gas phase constituents which a filter means is capable of removing. While filtration efficiency is perhaps the most important property of cigarette filter means, other properties must also be considered, including pressure drop, taste, hardness, appearance and cost. It is necessary to produce a filter which satisfies commercial requirements in each of these areas. Frequently, certain of these properties must be compromised in order to satisfy the need for others. For example, the most commonly utilized cellulose acetate filter means has a relatively low filtration efficiency since increased efficiency can only be obtained either by increasing the density of the filter material or the length of the filter element, both of which produce a pressure drop across the filter which is excessive and unacceptable from a commercial standpoint. While various suggestions have been made for the production of filter means which have improved filtering properties, most prior art developments have not been commercially acceptable either because the resulting filter means have been found to have objectionable "taste" characteristics whereby cigarettes provided with such filtering means fail to satisfy a large segment of the smoking public, or because the techniques and/or the materials utilized in the production of such filter means have increased the cost excessively.

High filtration efficiency is considered by the industry to be removal of 60% or more of total particulate matter. Cigarette filters having such properties are presently being produced in accordance with the teachings of U.S. Pat. Nos. 3,533,416, 3,599,646, 3,637,447, 3,648,711, 3,805,801 and 3,810,477, all of which are commonly assigned with the instant application. The disclosures of these prior art patents are incorporated herein in the entirety by reference.

However, it would be commercially desirable to be able to produce yet another tobacco smoke filter means having high filtration efficiency, low pressure drop and other satisfactory commercial properties.

Therefore, it is a primary object of this invention to provide a cigarette filter means or the like and a method and means for manufacturing same wherein the product has satisfactory pressure drop and other commercial requirements, and which may have both solid and gas phase filtration properties.

A further object of this invention is the provision of a cigarette filter or the like which has an inner member provided with a multiplicity of cavities to improve the flow path of tabacco smoke and enable greater utility of the filtering material from which it is made, while simultaneously permitting a conventional plug wrap to be used as an outer member which is substantially continuously supported throughout its length by the inner member so as to avoid the need for an internal glue line as has been required by the prior art techniques.

Yet another object of this invention is the provision of a filter means of the type described wherein, if desired, one or more of the cavities can be at least partially filled by a further smoke-modifying material such as activated carbon or the like.

Still another object of this invention is the provision of a cigarette smoke filter having a unique appearance enabling unusual esthetic effects to be produced.

Other and further objects of this invention reside in the chemical and physical characteristics of the filter product, as well as the manipulative steps utilized in the production and the various features of construction found in the manufacturing apparatus. Still other objects will in part be obvious and in part be pointed out as the description of the invention proceeds, and as will be seen from the accompanying drawings, wherein.

Like reference characters refer to like parts throughout the several views of the drawings.

Figures 1, 2, 3, 4, 5, 6:
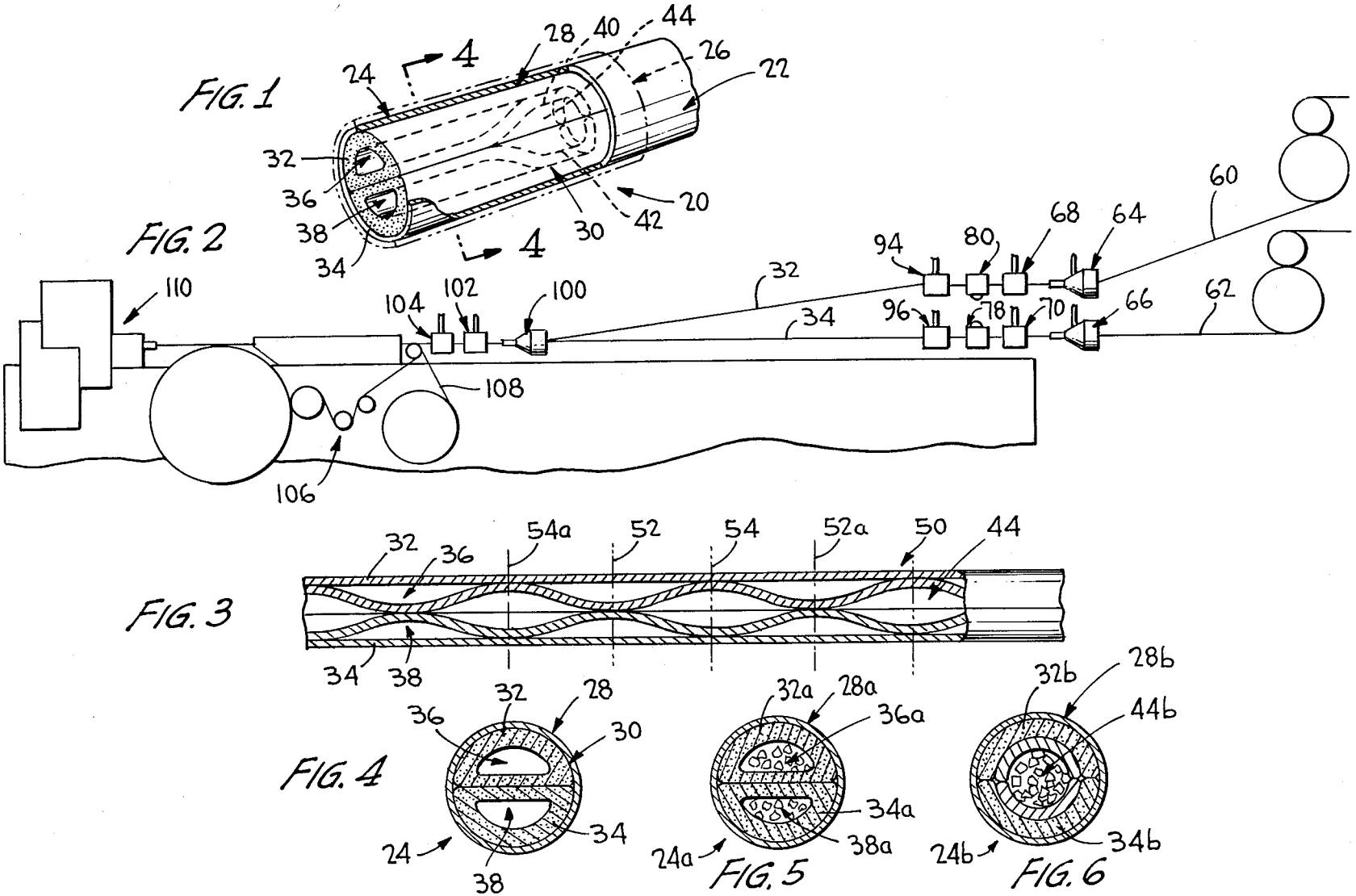
FIG. 1 is an enlarged perspective view of one form of filtered cigarette produced according to the instant invention, parts being broken away for illustrative clarity and convenience.
FIG. 2 is a schematic view of a method and means for making filter elements according to the instant inventive concepts.
FIG. 3 is a fragmentary view of a filter rod produced according to this invention, parts being in section and parts being broken away for illustrative clarity.
FIG. 4 is a transverse cross-sectional view through the filter element of the filtered cigarette of FIG. 1, taken substantially along lines 4—4 of FIG. 1.
FIG. 5 is a view similar to FIG. 4 through a modified filter element.
FIG. 6 is a transverse cross-sectional view through yet a further modification of a filter element according to this invention, the cross-section of FIG. 6 being taken through the composite inner cavity to be discussed in more detail hereinafter.

Referring now to the drawings, and more particularly to FIG. 1, a filtered cigarette according to the instant inventive concepts is designated generally by the reference numeral 20 and comprises basically a tobacco rod shown partially at 22 and a filter element according to one embodiment of this invention designated generally by the reference numeral 24, a conventional tipping overwrap being shown in dotted lines at 26 securing the tobacco rod and the filter element in end-to-end relationship according to well known prior art techniques.

The filter element 24 comprises basically an axially elongated, hollow, outer member 28 formed by conventional plug wrap as will be explained hereinafter in more detail, and an axially elongated, substantially cylindrical, composite inner member designated generally by the reference numeral 30 disposed within the outer member 28.

The composite, substantially cylindrical, inner member 30 is formed of a pair of mating, axially elongated, hollow, semi-cylindrical inner elements 32, 34, each of which is preferably and primarily formed from a continuous tow of cellulose acetate filamentary material, although other filtering material may be used with slight modifications. For example, filmentary tow formed of other materials such as polyethylene, polypropylene and the like or even non-woven stable filters of the type described in some detail in U.S. Pat. Nos. 3,297,041 and 3,552,400, also commonly assigned, the disclosures of which are incorporated herein by reference, may also be used. In fact, it is possible to produce filter elements according to this invention from an extruded, open-celled, foam material, such as cellulose acetate foam or the like. However, since cellulose acetate filamentary tow is the presently preferred material from a commercial standpoint, the remainder of this specification will be directed to the use of such material.

Thus, each of the semi-cylindrical elements 32, 34 are preferably formed of crimped filamentary cellulose acetate members bonded together at their contact points to form a smoke-permeable element defining a tortuous path for passage of smoke therethrough. Filtering material of this nature is well known, as are techniques for producing same.

As will be seen particularly from FIGS. 1 and 4, integral circumferentially continuous peripheral portions of the outer surface of the composite inner member 30 are juxtaposed to portions of the inner surface of the outer member 28 to at least substantially preclude axial passage of smoke across the area therebetween. By thus providing substantially uniform continuous support for the outer member 28 over its entire length it is possible to use a lighter weight plug wrap for the outer member 28 than is required when significant portions of the inner member are spaced from the outer member as, for example, in a filter of the type shown in U.S. Pat. No. 3,533,416. Moreover, this substantially uniform support precludes the need for an internal glue line between the inner and outer members as has been necessary with prior art techniques.

It will be seen that each of the semi-cylindrical inner members 32,34 define discrete inner cavities, 36,38, with depressed portions 40,42 of the semi-cylindrical elements 32,34, respectively, together forming a composite cavity 44 spaced from the discrete inner cavities 36,38.

Of course, it is possible to reverse the filter element 24 in the filtered cigarette 20 so that the composite inner cavity 44 is at the mouthpiece end of the filtered cigarette with the discrete cavities 36,38 being juxtaposed to the tobacco section 22.

In FIG. 3 a continuous rod 50 made up of a multiplicity of integrally connected filter elements of the type shown at 24 in FIG. 1 will be seen. The rod 50 may be severed transversely along the lines 52,54 to produce individual filter elements such as shown at 24. Of course, the rod could be severed at other locations to produce filter elements of multiple length. For example, the rod could be severed at 52 and **52*a* to produce a double filter having a totally enclosed composite inner cavity 44 or at 54 and 54*a* to produce a double filter having totally enclosed discrete inner cavities 36,38**. Moreover, it is common practice to initially produce double filters which are then secured to two tobacco sections by a common tipping overwrap following which individual filtered cigarettes are formed by severing the double filter at its midpoint.

Although in the embodiment of FIGS. 1, 3 and 4 the cavities 36,38 and 44 have been shown as empty, it is possible to at least partially fill one or more of these cavities with a further smoke-modifying material such as, for example, activated carbon. In FIG. 5, a modified embodiment of the instant inventive concept is shown wherein the discrete inner cavities are at least partially filled with such material and in FIG. 6 a further modified form is shown in which the composite inner cavity includes such further smoke-modifying material. Since these embodiments are basically identical to the embodiment of FIG. 1, similar reference numerals have been used, with the embodiment of FIG. 5 carrying a suffix "*a*" and the embodiment of FIG. 6 carrying a suffix "*b*". Further, it is believed obvious that all of the cavities could be filled in an individual filter element. Moreover, although activated carbon and loose granules have been suggested as a further smoke-modifying material, other conventional materials could be substituted therefor, including activated carbon or other sorbent particles bonded by small particles of polyethylene or the like or loose sorbent particles of other materials such as silica gel or the like.

These further smoke-modifying materials added gas phase activity to the filter element, enabling the removal of undesirable gas phase constituents while the filtering material of the composite inner member itself functions as the primary filter for the solid phase constituents of the tobacco smoke. In addition to adding gas phase capability to the filter element, inclusion of materials of this nature in the cavities produces a filter having a unique appearance.

Figure 7:
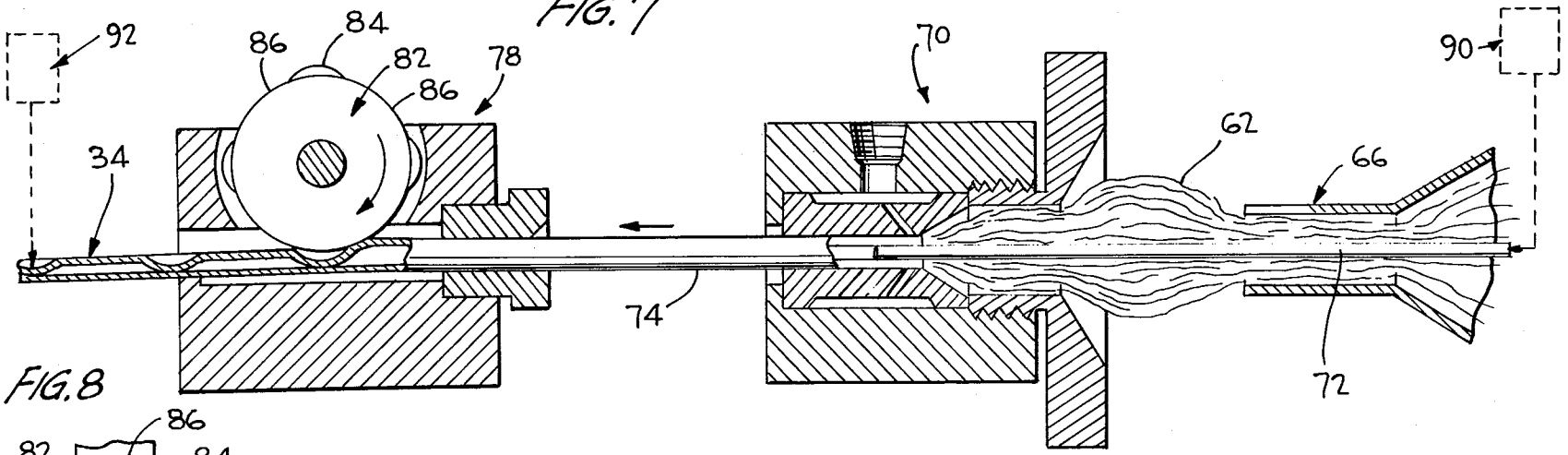
FIG. 7 is an enlarged cross-sectional view through a mechanism for initially forming an inner cylindrical element and reforming that element into a semi-cylindrical form, means for adding a further smoke-modifying material to the various cavities being shown in dotted lines.

Reference is now made particularly to FIGS. 2 and 7–9 for the overall method and means utilized in producing filter elements in accordance with this invention. The initial phases of the production line are quite similar in many respects to the concepts shown and described in detail in U.S. Pat. No. 3,637,447 referred to previously. According to preferred embodiments of this invention separate sources of filter material in the form of continuous filamentary tows 60,62, each of which includes a multiplicity of bondable fibrous members activated by contact with a hot fluid such as steam, are provided. These materials may be the same, if desired, or different filtering materials could be utilized for production of the individual semi-cylindrical elements to be described further hereinafter. However, for simplicity, it will be presumed that in each instance, a continuous cellulose acetate filamentary tow is being utilized. In each instance, the filtering material is continuously passed into and through an elongated bonding zone which may comprise conventional stuffer jets 64,66 and steam heads 68,70 similar in nature to those shown in various of the abovementioned prior art patents. Details of the stuffer jet and steam head 66,70 are shown in FIG. 7, it being understood that similar means are provided for processing the filtering material 60. A mandrel 72 is positioned generally axially of the bonding zone to define an annular space through which the filtering material 62 must pass. Thus, in the steam head 70 the fibrous members of the filter material 62 are contacted by the bond activating agent, namely, steam, to produce a smoke-permeable annular wall of bonded fibrous members designated generally by the reference numeral 74 in FIG. 7. This cylindrical element 74 is fed into a reforming means 78 shown in detail in FIGS. 7 and 8 (a similar reforming means 80 being provided for the filtering material 60). The reforming means 78 comprises a rotatably supported reforming wheel 82 having spaced humps 84 and intermediate flat sections 86 which engage the cylindrical element 74 as it passes through the reforming means 78, the flattened sections 86 reforming the substantially cylindrical element 74 into a semi-cylindrical element with the humps 84 producing spaced pockets therein to thereby form the integral inner cavities 36,38 and a portion of what is to become the composite cavities 44. If necessary, the substantially cylindrical inner element 74 may be contacted with steam in the reforming means 78 in order to soften this element and facilitate the reforming by the wheel 82.

If it is desired to incorporate a further smokemodifying material into the discrete inner cavities **34*a*, 36*a* as shown in FIG. 5, such material may be intermittently fed from a source of same shown in dotted lines at 90 in FIG. 7 through the interior of a hollow mandrel 72. Similarly, if it is desired to provide a further smoke-modifying material within the composite inner cavity 44*b* as shown in FIG. 6, such material may be fed from a source of same shown in dotted lines at 92 in FIG. 7 into the pocket formed by the humps 84 prior to integrating the individual semi-cylindrical elements 32,34**.

Figure 9:
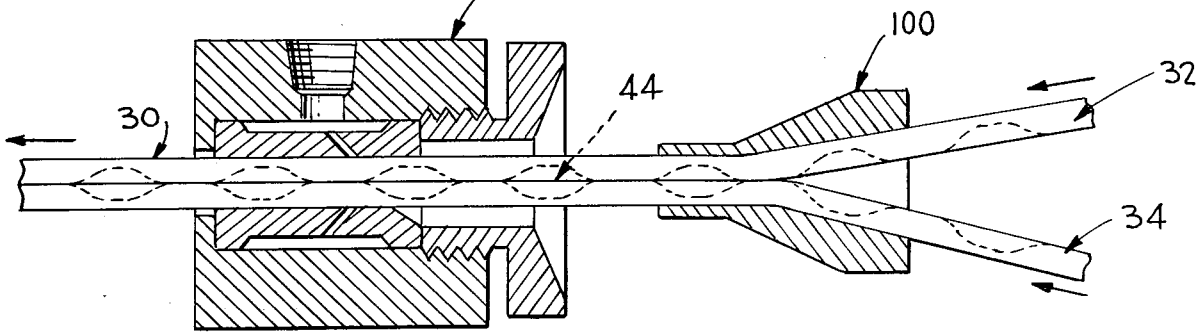
FIG. 9 is a cross-sectional view showing the method and means for integrating the semi-cylindrical elements into a composite cylindrical inner member.
Figure 8:
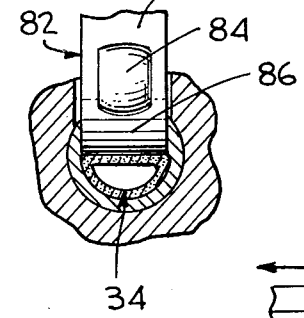
FIG. 8 is a fragmentary cross-sectional view showing the operation of the reforming wheel in further detail.

After reforming, the semi-cylindrical elements 32,34 can be cooled in conventional cooling heads illustratively shown at 84,96 in FIG. 2 and then passed to and through a rod guide 100 and a further steam head 102, shown in detail in FIG. 9, and a cooling head 104 to mate the semicylindrical inner elements 32,34 and reform them into a true cylindrical shape to produce the substantially cylindrical composite inner member 30.

A garniture is shown at 106 in FIG. 2 to provide a continuous pulling mechanism drawing all of the elements through the processing steps and to simultaneously overwrap the composite inner member 30 with a conventional plug wrap 108 to form the outer member 28. If desired, or if necessary, separate pulling means may be provided for the individual semi-cylindrical inner elements 32,34 such means not being shown for illustrative convenience.

Finally, the rod is severed transversely at selected locations in a cutting means shown schematically at 110 in FIG. 2.

The following data compares certain characteristics of products made according to the instant inventive concepts designated as "I" and "II" with products produced according to prior art techniques, a single filter element of the type shown, for example, in U.S. Pat. No. 3,637,447 being designated as "III" and a double filter element of the type shown in U.S. Pat. No. 3,805,801 being designated as "IV" in the table below.

| Type | Weight | Pressure Drop | Percent Retention |
|---|---|---|---|
| I | 18.2 gms | 1.8" | 66.2 |
| II | 16.3 gms | 3.5" | 75.0 |
| III | 16.5 gms | 2.8" | 69 |
| IV | 13.4 gms | 2.8" | 65 |

It will be seen from the above that filter elements prepared according to the instant inventive concepts can be produced having favorable pressure drop characteristics as well as good filtration efficiency. Other commercially significant properties such as hardness, taste and the like also compare favorably with prior art filters. Moreover, the filter of this invention has the particular advantage of being able to readily incorporate further smoke-modifying materials such as activated carbon or the like and, additionally, to provide unique esthetic appearances.

It will now be seen that there is herein provided a smoke filter and method and means for manufacturing same which satisfies the various objectives set forth previously, and which provides significant advantages of a commercial nature. While this invention has been described with reference to presently preferred exemplary embodiments thereof, it should be understood that the invention is not limited thereto, but may be variously practiced within the scope of the following claims.

However, although the filter product of this invention has been shown without cavities between the inner surface of the outer member and the outer surface of the composite inner member, it should be understood that limited external cavities of the type shown and described in copending U.S. patent application Ser. No. 627,858 filed Oct. 31, 1975, the disclosure of which is incorporated herein in its entirety by reference, can be provided to enhance the smoke flow characteristics while still permitting the use of conventional plug wrap and avoiding the need for an internal glue line.

The embodiments of the invention in which an exclusive property or privilege is claimed are defined as follows:

1. A method of making smoke filters comprising the steps of:

a. providing a first filtering material including a multiplicity of fibrous members;

b. defining a first elongated substantially cylindrical, annular bonding zone;

c. continuously passing said first filtering material through said first bonding zone and during passage of said first filtering material through said first bonding zone contacting same with a bond activating agent to bond said fibrous members of said first filtering material to each other at spaced contact points thereby forming a first elongated, smoke-permeable, cylindrical inner element having an axial bore and an annular wall defining a tortuous path for passage for smoke therethrough;

d. subjecting an arcuate section of the annular wall of said first cylindrical inner element to alternating axially spaced flattening and depressing actions to thereby reform said first cylindrical inner element into a first semi-cylindrical inner element having alternating axially spaced externally flattened portions and externally depressed portions, with said externally depressed portions forming axially spaced sections extending across the interior of said first semi-cylindrical inner element which offer at least as much resistance to passage of smoke as the material of said first semi-cylindrical inner element and which define together with said externally flattened portions a multiplicity of axially spaced, discrete, first cavities within said first semi-cylindrical inner element;

e. providing a second filtering material including a multiplicity of fibrous elements;

f. defining a second elongated substantially cylindrical, annular bonding zone;

g. continuously passing said second filtering material through said second bonding zone and during passage of said second filtering material through said second bonding zone contacting the same with a bond activating agent to bond said fibrous members of said second filtering material to each other at spaced contact points thereby forming a second elongated, smoke-permeable, cylindrical inner element having an axial bore and an annular wall defining a tortuous path for passage of smoke therethrough;

h. subjecting an arcuate section of the annular wall of said second cylindrical inner element to alternating axially spaced flattening and depressing actions to thereby reform said second cylindrical inner element into a second semi-cylindrical inner element having alternating axially spaced externally flattened portions and externally depressed portions, with said externally depressed portions forming axially spaced sections extending across the interior of said second semi-cylindrical inner element which offer at least as much resistance to passage of smoke as the material of said second semi-cylindrical inner element and which define together with said externally flattened portions a multiplicity of axially spaced, discrete, first cavities within said second semi-cylindrical inner element;

i. continuously juxtaposing said first and second semi-cylindrical inner elements to each other with said externally depressed portions of said semi-cylindrical inner elements facing each other to form a composite cylindrical inner member having alternating discrete first cavities and composite second cavities defined by said depressed portions of said semi-cylindrical inner elements;

j. overwrapping said composite cylindrical inner member with an overwrapping material so as to juxtapose portions of the inner surface of said overwrapping material with the outer surface of said composite cylindrical inner member to form sealed areas precluding axial passage of smoke thereacross; and k. transversely severing the resulting product at selected locations to form filter elements each having at least a portion of two discrete first cavities and at least a portion of one composite second cavity.

2. A method according to claim 1 wherein said first and second filtering materials each comprise cellulose actate tow and said bond activating agents comprise steam.

3. A method according to claim 1 further comprising feeding a further smoke-modifying material into at least one of said cavities.

4. A method according to claim 3 wherein said further smoke-modifying material comprises activated carbon.

5. An apparatus for making smoke filters comprising:

a. a source of a first filtering material including a multiplicity of fibrous members;

b. means defining a first elongated, substantially cylindrical, annular bonding zone;

c. means for continuously passing said first filtering material through said first bonding zone and during passage of said first filtering material through said first bonding zone contacting same with a bond activating agent to bond said fibrous members of said first filtering material to each other at spaced contact points thereby forming a first elongated, smoke-permeable, cylindrical inner element having an axial bore and an annular wall defining a tortuous path for passage of smoke therethrough;

d. means for subjecting an arcuate section of the annular wall of said first cylindrical inner element to alternating axially spaced flattening and depressing actions to thereby reform said first cylindrical inner element into a first semi-cylindrical inner element having alternating axially spaced externally flattened portions and externally depressed portions, with said externally depressed portions forming axially spaced sections extending across the interior of said first semi-cylindrical inner element which offer at least as much resistance to passage of smoke as the material of said first semi-cylindrical inner element and which define together with said externally flattened portions a multiplicity of axially spaced, discrete, first cavities within said first semi-cylindrical inner element;

e. a source of a second filtering material including a multiplicity of fibrous members;

f. means defining a second elongated, substantially cylindrical, annular bonding zone;

g. means for continuously passing said second filtering material through said second bonding zone and during passage of said second filtering material through said second bonding zone contacting the same with a bond activating agent to bond said fibrous members of said second filtering material to each other at spaced contact points thereby forming a second elongated, smoke-permeable, cylindrical inner element having an axial bore and an annular wall defining a tortuous path for passage of smoke therethrough;

h. means for subjecting an arcuate section of the annular wall of said second cylindrical inner element to alternating axially spaced flattening and depressing actions to thereby reform said second cylindrical inner element into a second semi-cylindrical inner element having alternating axially spaced externally flattened portions and externally depressed portions, with said externally depressed portions forming axially spaced sections extending across the interior of said second semi-cylindrical inner element which offer at least as much resistance to passage of smoke as the material of said second semicylindrical inner element and which define together with said externally flattened portions a multiplicity of axially spaced, discrete, first cavities within said second semi-cylindrical inner element;

i. means for continuously juxtaposing said first and second semi-cylindrical inner element to each other with said externally depressed portions of said semicylindrical inner elements facing each other to form a composite cylindrical inner member having alternating discrete first cavities and composite second cavities defined by said depressed portions of said semi-cylindrical inner elements;

j. means for overwrapping said composite cylindrical inner member with an overwrapping material so as to juxtapose portions of the inner surface of said overwrapping material with the outer surface of said composite cylindrical inner member to form sealed areas precluding axial passage of smoke thereacross; and k. means for transversely severing the resulting product at selected locations to form filter elements each having at least a portion of two discrete first cavities and at least a portion of one composite second cavity.

6. An apparatus according to claim 5 wherein said first and second filtering materials each comprise cellulose acetate tow and said bond activating agents comprise steam.

7. An apparatus according to claim 5 further comprising means for feeding a further smoke-modifying material into at least one of said cavities.

8. An apparatus according to claim 7 wherein said further smoke-modifying material comprises activated carbon.

* * * * *